United States Patent [19]

Arp

[11] 4,452,585

[45] Jun. 5, 1984

[54] COMBUSTION AIR BLOWER SURGE CONTROL FOR A MELTING FURNACE

[75] Inventor: David F. Arp, Carrollton, Ga.

[73] Assignee: Southwire Company, Carrollton, Ga.

[21] Appl. No.: 155,321

[22] Filed: Jun. 2, 1980

[51] Int. Cl.[3] ..... F27D 7/00; F27B 1/26; F01B 25/00

[52] U.S. Cl. ..... 432/24; 415/13; 432/36

[58] Field of Search ..... 432/29, 24, 36; 415/13, 415/26, 36, 49

[56] References Cited

U.S. PATENT DOCUMENTS

| | | | |
|---|---|---|---|
| 1,216,119 | 2/1917 | Hinz | 415/49 |
| 2,290,770 | 7/1942 | Schomann | 415/49 |
| 3,276,674 | 10/1966 | Hens | 415/49 |
| 3,424,370 | 1/1969 | Law | 415/1 |
| 3,606,282 | 9/1971 | Stookey | 432/29 |

*Primary Examiner*—John J. Camby

*Attorney, Agent, or Firm*—Herbert M. Hanegan; Robert S. Linne; Michael C. Smith

[57] ABSTRACT

Disclosed is a surge control method and apparatus for a combustion air blower used with a metal melting furnace which includes a variable restriction on the blower inlet regulated by a pressure sensing means near the blower outlet.

29 Claims, 4 Drawing Figures

COMBUSTION AIR BLOWER SURGE CONTROL FOR A MELTING FURNACE

BACKGROUND OF THE INVENTION

1. Field of the Invention

The present invention relates generally to metal melting furnaces, and specifically to a surge controller for a combustion air blower for supplying combustion air to a vertical shaft furnace for the continuous melting of metal.

2. Description of the Prior Art

In the prior art, there are many types of vertical furnace arrangements that have been used for melting various types of charge materials under a wide variety of different circumstances, such as the typical units disclosed in U.S. Pat. Nos. 2,203,163; 2,815,278; 2,886,304; 3,148,973; 3,199,977; 3,603,571; and, 3,958,919. U.S. Pat. Nos. 3,715,203; 3,788,623; and 3,809,378 generally disclose specific types of furnace arrangements that are particularly useful in melting non-ferrous metals such as copper.

Modern industrial heating processes and especially metal melting furnaces require burners which have a number of characteristics. Burners may be classified into three basic types, depending on the method of mixing the fuel and air.

The simplest arrangement, often called a throat-mix burner, consists of admitting the fuel and air into the combustion chamber through separate ports, usually adjacent to each other, and allowing the two to mix and burn in the furnace. This method of burning produces large, relatively slow-moving flames and has been widely used in firing open hearth steel furnaces.

A second type of mixing is found in the inspirator type of burner wherein the fuel is delivered to the burner under pressure and is discharged from a nozzle or jet in such a way that its momentum is used in mixing the fuel with indrawn air.

The third type of burner involves premixing all or part of the air with the fuel prior to delivery to the burner. With this arrangement the burner itself may be a nozzle designed to deliver the combustible mixture without backfire or flame blowoff. U.S. Pat. No. 4,211,555 discloses such a premixing system.

Within the prior art directed towards burners and their specific structural configurations, many varying types of burners have been designed to operate under a wide variety of particular applications and environments for use in heating a material charge having various individual characteristics. Such burners include those as disclosed in U.S. Pat. Nos. 2,605,180; 3,701,517; 3,852,021; and 4,154,571.

A vertical shaft furnace for the continuous melting of metal is normally fired with a burner of the first or third type above and using a gas fuel, liquid fuel, or a premixed gas or liquid and air fuel. Each type of burner system requires a large amount of combustion air which is usually forced into the system by means of a blower or fan designed to supply a high volume of air at low pressure. See for example, blower 14 or blower 24 of FIG. 1 in the above mentioned U.S. Pat. No. 4,211,555, or the blowers in U.S. Pat. No. 4,301,997, or blower 37 of FIG. 1 of the above mentioned U.S. Pat. No. 3,199,977.

Since melting and processing of metal is not a completely continuous and uniform process due to start-ups, processing interruptions, processing rate adjustments, and shutdown, means for firing a metal melting furnace must have the ability to vary the firing rates. Variations in firing rates cause combustion air demand variations.

Combustion air demand variations are inefficiently compensated for in conventional combustion air blower systems. Typically, the blower is designed to run at maximum capacity with only a slight or no speed regulation possible, resulting in the practice of dumping vast quantities of excess combustion air. Such a conventional system wastes energy, is needlessly noisy because of high velocity air dump, and does not constantly and accurately provide the required consistancy of combustion air pressure.

SUMMARY OF THE INVENTION

The present invention is a surge control method and apparatus for a combustion air blower specifically adapted for a vertical shaft metal melting furnace, for melting metal pieces such as copper. This invention comprises a motorized butterfly valve on the combustion air intake of a combustion air blower, a pressure transducer to monitor the blower output, and an adjustable set point pressure controller to regulate the valve in response to the monitored pressure. The blower operates more efficiently than prior art systems by limiting the amount of combustion air allowed to enter the blower during a low demand situation. The pressure transducer reads blower outlet pressure and converts it to an electric, pneumatic or hydraulic signal which is transmitted to the pressure controller. The pressure controller determines corrective action required and adjusts the butterfly valve accordingly to maintain a relatively constant blower outlet pressure regardless of flow demand.

Thus a major objective of this invention is to provide an apparatus and a method for controlling a combustion air blower for supplying combustion air to a vertical shaft furnace for continuous melting of metal.

Another object of this invention is to improve overall blower efficiency.

Still another object of the present invention is to accurately provide constant pressure of combustion air during combustion air demand flucutations.

Yet another object of this invention is to provide a quieter combustion air control system.

BRIEF DESCRIPTION OF THE DRAWINGS

While the specification concludes with claims particularly pointing out and distinctly claiming the subject matter which is regarded as the invention, it is believed that the invention, objects, features and advantages thereof will be better understood from the following description taken in connection with accompanied drawings in which like parts are given like identification numerals and wherein:

DESCRIPTION OF THE PREFERRED EMBODIMENT

Figure 1:
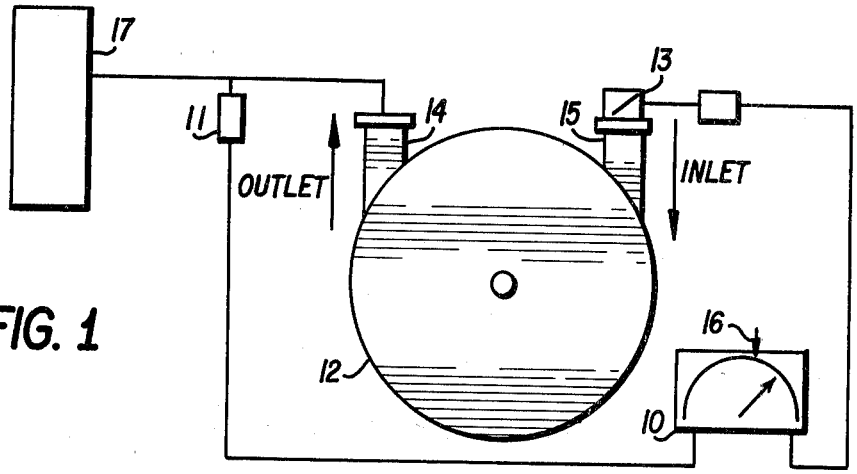
FIG. 1 is schematic of a preferred embodiment of the present invention.

Referring to FIG. 1, an adjustable setpoint pressure controller 10 (well known in the art, for example a Foxboro model 43A) is set to a point by set point means 16 which corresponds to the pressure required to force the maximum required amount of combustion air through the system. A pressure transducer 11 continuously reads the outlet pressure 14 of the centrifugal combustion air blower 12 and converts it to a corresponding pressure signal, preferrably electric, pneumatic or hydraulic and transmits it to the pressure controller 10 which determines any required corrective action and generates an adjustment signal to adjust a motorized butterfly intake regulator valve 13 located in the combustion air blower intake 15, accordingly to maintain constant blower outlet pressure 14 regardless of flow demand fluctuations.

In the preferred embodiment, the pressure controller 10 sends a pulse signal to the butterfly intake valve 13 making small incremental changes to the pressure signal from the pressure transducer 11.

Thus accurate and constant combustion air pressure is efficiently maintained to furnace 17 regardless of combustion air demand fluctuations without energy waste and needless noise.

Figure 2:
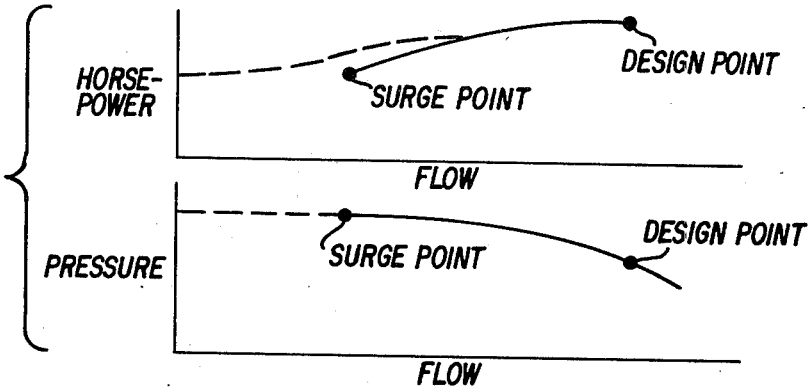
FIG. 2 is a graph of horsepower versus pressure in a conventional prior art system.

FIG. 2 illustrates horsepower versus pressure in a conventional system. The solid line represents a normal blower operation curve and the broken line shows performance of a conventional system. Horsepower waste and pressure instability are clearly evident in prior art systems.

Figure 3:
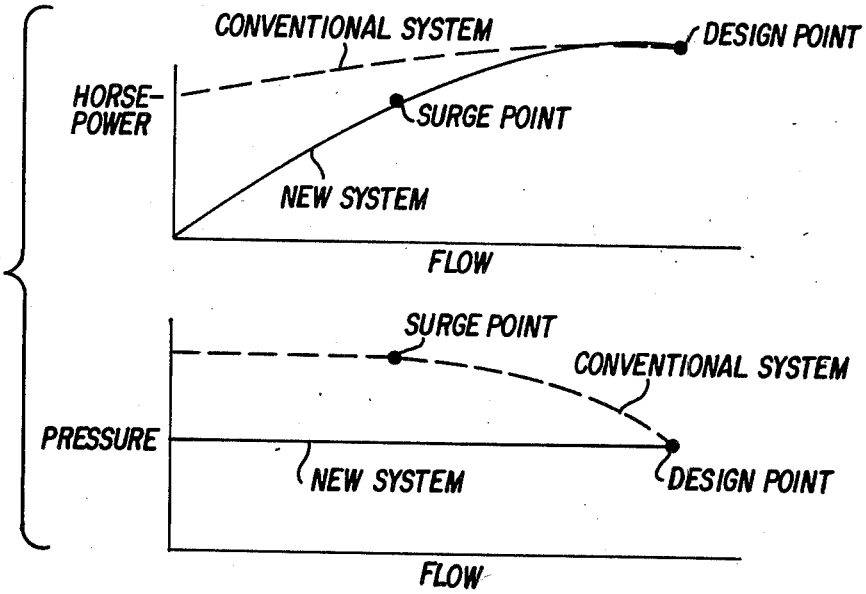
FIG. 3 is a graph comparing horsepower and pressure of a conventional prior art system and the present invention.

FIG. 3 compares horsepower and pressure in a conventional system and in the present invention. The present invention is represented by the solid line while the conventional system is represented by the broken line. Excessive horsepower use of the conventional system over the present invention is particularly evident at low flow demand. Also, pressure of the present invention remains constant while pressure of the conventional system fluctuates severly as flow demand changes.

Figure 4:
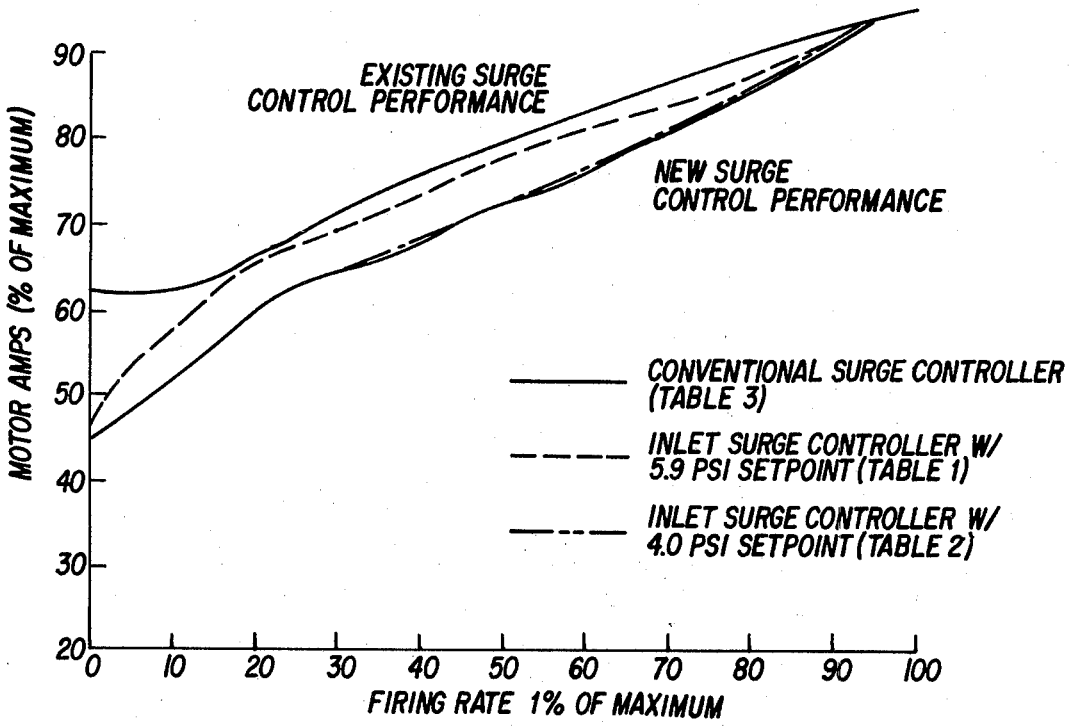
FIG. 4 is a graph comparing operating data of a conventional system and the present invention.

In FIG. 4, the dash-dash broken line illustrates performance of the present invention with the pressure controller 10 set at 5.9 psi, the dash-dot broken line illustrates performance of the present invention with the pressure controller 10 set at 4.0 psi, and the unbroken line illustrates performance of the conventional system.

The following table 1 corresponds to the dash-dash line of FIG. 4 and shows that at a pressure controller 10 setting of 5.9 psi the blower pressure held very constant through out a wide range of firing rates while power consumption decreased significantly as the firing rate decreased.

TABLE 1

| Inlet Surge Control w/ 5.9 psi Set Point | | | | |
|---|---|---|---|---|
| Fire Rate | Blower Pressure (psi) | Blower Motor AMPS | Blower Air Temperature | Inlet Valve Condition |
| 64 | 5.9 | 87 | 168° F. | ⅞ OPEN, STEADY |
| 50 | 5.8 | 79 | 172° F. | 11/16 OPEN, STEADY |
| 40 | 5.8 | 75 | 173° F. | ⅝ OPEN, STEADY |
| 30 | 5.8 | 70 | 175° F. | ½ OPEN, STEADY |
| 20 | 5.8 | 65 | 176° F. | 7/16 OPEN, STEADY |
| 15 | 5.9 | 62 | 178° F. | ⅜ OPEN, STEADY |
| 10 | 5.8 | 57 | 178° F. | 5/16 OPEN, STEADY |
| 5 | 5.8 | 52 | 179° F. | 5/16 OPEN, STEADY |
| 2 | 5.8 | 48 | 179° F. | ¼ OPEN, STEADY |
| 0 | 5.8 | 43 | 178° F. | 3/16 OPEN, STEADY |

Table 2 corresponds to the dash-dot line of FIG. 4 and shows that at a pressure controller setting of 4.0 psi the blower pressure remained constant over a wide range of firing rates while power consumption decreased significantly as the firing rate decreased.

TABLE 2

| Inlet Surge Control w/ 4.0 psi Set Point | | | | |
|---|---|---|---|---|
| Fire Rate | Blower Pressure (psi) | Blower Motor AMPS | Blower Air Temperature | Inlet Valve Condition |
| 43 | 4.1 | 73 | 186° FF | ⅜ OPEN, STEADY |
| 40 | 4.1 | 70 | 187° FF | ⅜ OPEN, STEADY |
| 30 | 4.1 | 66 | 188° FF | ⅜ OPEN, STEADY |
| 20 | 4.1 | 60 | 188° FF | 5/16 OPEN, STEADY |
| 15 | 4.0 | 57 | 187° FF | ¼ OPEN, STEADY |
| 10 | 4.0 | 52 | 186° FF | ¼ OPEN, STEADY |
| 5 | 4.1 | 47 | 183° F. | 3/16 OPEN, STEADY |
| 2 | 4.0 | 44 | 182° F. | 3/16 OPEN, STEADY |
| 0 | 3.9–4.3 | 42 | 178° F. | ⅛ OPEN, UNSTEADY |

Table 3 corresponds to the solid line of FIG. 4 and illustrates unacceptable pressure fluctuation and excessive power consumption.

TABLE 3

| Conventional System | | | | |
|---|---|---|---|---|
| Fire Rate | Blower Pressure (psi) | Blower Motor AMPS | Blower Air Temperature | Inlet Valve Condition |
| 64 | 5.9 | 87 | 183° F. | FULL OPEN |
| 50 | 6.2 | 82 | 183° F. | FULL OPEN |
| 40 | 6.4 | 77 | 183° F. | FULL OPEN |
| 30 | 6.5 | 72 | 184° F. | FULL OPEN |
| 20 | 6.7 | 67 | 184° F. | FULL OPEN |
| 15 | 6.7 | 63 | 184° F. | FULL OPEN |
| 10 | 6.7 | 59 | 184° F. | FULL OPEN |
| 5 | 6.7 | 58 | 184° F. | FULL OPEN |
| 2 | 6.7 | 58 | 184° F. | FULL OPEN |
| 0 | 6.7 | 58 | 184° F. | FULL OPEN |

As the data indicates there are a number of advantages to using this invention the most prominent being the savings in electrical energy. In addition to this, other advantages are:

Less motor and blower load on startup.

Combustion air is supplied at a constant pressure.

More accessible than the conventional system thus, more easily maintained.

Significant noise reduction.

FIG. 4's graphic illustration shows the electricity savings which can be achieved with the present invention.

While this invention has been described in detail with particular reference to a preferred embodiment thereof, it will be understood that variations and modifications can be effective within the spirit and scope of the invention as described hereinbefore and as defined in the appended claims.

What is claimed is:

1. An apparatus for controlling the flow rate of combustion air to a metal melting furnace while maintaining substantially constant pressure comprising:

a combustion air blower;

a combustion air intake regulator valve connected to said combustion air blower;

a combustion air outlet pressure transducer connected to said combustion air blower for monitoring outlet pressure and generating a pressure signal;

a pressure controller connected to said transducer for receiving said pressure signal, determining required corrective action, and generating an adjustment signal; and means connected to said controller for receiving and converting said adjustment signal into adjustment of said intake regulator valve.

2. The apparatus of claim 1 wherein said combustion air blower is a centrifugal blower.

3. The apparatus of claim 1 wherein said combustion air intake regulator valve is a motorized butterfly valve.

4. The apparatus of claim 1 wherein said pressure signal is an electric signal.

5. The apparatus of claim 1 wherein said pressure signal is a pneumatic signal.

6. The apparatus of claim 1 wherein said pressure signal is a hydraulic signal.

7. The apparatus of claim 1 wherein said pressure controller is an adjustable setpoint pressure controller.

8. The apparatus of claim 7 wherein said adjustable setpoint pressure controller is set at a point which corresponds to the pressure required to force the maximum required amount of combustion air through the system.

9. The apparatus of claim 1 wherein said means for converting said adjustment signal into adjustment of said intake regulator valve is adapted to transmit pulse adjustment signal to said intake regulator valve making small incremental adjustments thereto.

10. The apparatus of claim 1 wherein constant combustion air pressure is accurately maintained regardless of combustion air demand fluctuations.

11. The apparatus of claim 1 wherein energy consumption by said blower is significantly reduced as combustion air demand decreases by means which limit the combustion air intake to only that amount required by the system.

12. The apparatus of claim 1 wherein high velocity combustion air dump noise is substantially eliminated.

13. The apparatus of claim 1 wherein said furnace is a vertical shaft metal melting furnace.

14. The apparatus of claim 1 wherein said furnace is fired with a gas fuel, a liquid fuel, or a premixed gas or liquid and air fuel.

15. The apparatus of claim 1 wherein said metal is copper.

16. A method for controlling flow rate of combustion air to a metal melting furnace while maintaining substantially constant pressure comprising the steps of:

(a) forcing combustion air through a combustion air blower equipped with a combustion air intake regulator valve;

(b) monitoring combustion air pressure at the outlet of said blower;

(c) generating a pressure signal;

(d) determining required corrective action based on said pressure signal;

(e) generating an adjustment signal; and (f) converting said adjustment signal into adjustment of said intake regulator valve.

17. The method of claim 16 wherein said combustion air blower is a centrifugal blower.

18. The method of claim 16 wherein said combustion air intake regulator valve is a motorized butterfly valve.

19. The method of claim 16 wherein said pressure signal is an electrical signal.

20. The method of claim 16 wherein said pressure signal is a pneumatic signal.

21. The method of claim 16 wherein said pressure signal is a hydraulic signal.

22. The method of claim 16 wherein step (d) includes evaluating the pressure needed to force the maximum required amount of combustion air through the system.

23. The method of claim 16 wherein step (f) includes transmitting pulse adjustment signals to said intake regulator valve making small incremental adjustments thereto.

24. The method of claim 16 including accurately maintaining constant combustion air pressure regardless of combustion air demand fluctuations.

25. The method of claim 16 including substantially reducing blower energy waste by limiting the intake of combustion air to only that amount demanded by the system.

26. The method of claim 16 including eliminating needless high velocity combustion air dump noise.

27. The method of claim 16 wherein said furnace is a vertical shaft metal melting furnace.

28. The method of claim 16 wherein said furnace is fired with a gas fuel, a liquid fuel or a premixed gas or liquid and air fuel.

29. The method of claim 16 wherein said metal is copper.

* * * * *